United States Patent [19]

Balzer

[11] 4,432,176

[45] Feb. 21, 1984

[54] VERTICAL MODULAR CONSTRUCTION ELEMENT AND CONSTRUCTION METHOD USING THE SAME

[76] Inventor: M. Edmond H. M. Balzer, 42, Allées François-Verdier, 31000 Toulouse, France

[21] Appl. No.: 220,903

[22] Filed: Dec. 29, 1980

[30] Foreign Application Priority Data

Dec. 28, 1979 [FR] France ..... 79 32164

[51] Int. Cl.[3] ..... E02D 27/00

[52] U.S. Cl. ..... 52/293; 52/169.7; 52/294; 52/741

[58] Field of Search ..... 52/169.7, 293, 295, 52/294, 236.7, 236.8, 602, 79.11, 79.14, 250; 405/286, 284

[56] References Cited

U.S. PATENT DOCUMENTS

| | | | |
|---|---|---|---|
| 3,180,057 | 4/1965 | Pritzker | 52/293 |
| 3,693,308 | 9/1972 | Trezzini | 52/293 |
| 3,812,637 | 5/1974 | Yang | 52/236.8 |
| 4,145,861 | 3/1979 | Yarnick | 52/294 |

FOREIGN PATENT DOCUMENTS

| | | | |
|---|---|---|---|
| 1074604 | 10/1954 | France | 52/250 |
| 482896 | 1/1970 | Switzerland | 52/169.7 |

*Primary Examiner*—John E. Murtagh
*Attorney, Agent, or Firm*—Young & Thompson

[57] ABSTRACT

A vertical modular construction element of cast concrete rests at its lower end on spaced feet between which at least one closed steel loop is provided for the reception of threaded reinforcing rods that interconnect a series of such construction elements disposed side-by-side, for the construction of retaining walls, etc. The closed loop depends below the construction element a distance less than the height of the feet, so that the closed loop is spaced above the ground when the element rests on the ground on its feet. The elements can be either ribbed or rectangular in cross section. If ribbed, then there is a foot at the end of each free edge of each rib and the loop is embedded in one of the feet. In any case, the loops are the lower portions of U-shaped steel rods whose legs extend up along the height of the element and are embedded in the element so as to resist horizontal forces imposed on the element.

2 Claims, 10 Drawing Figures

FIG. 1
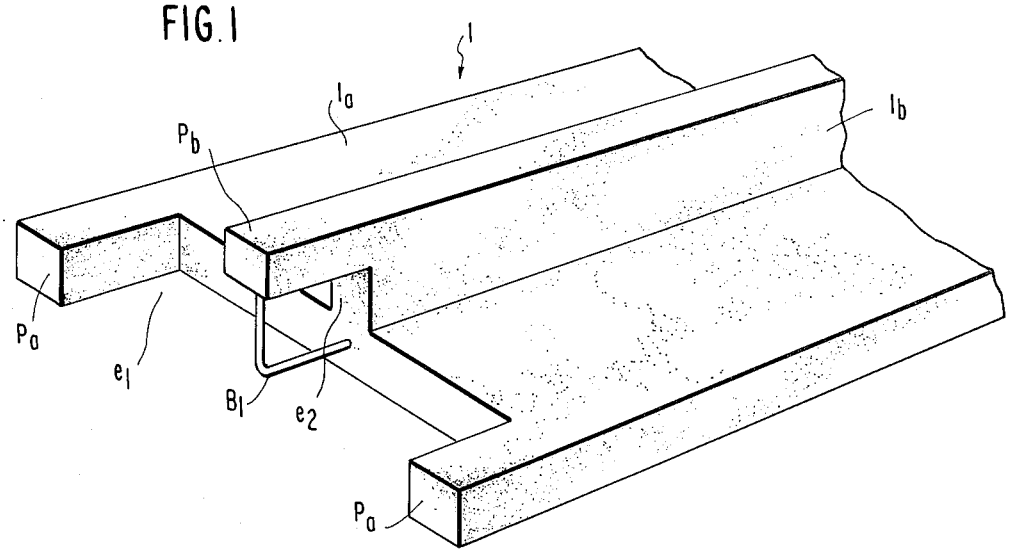
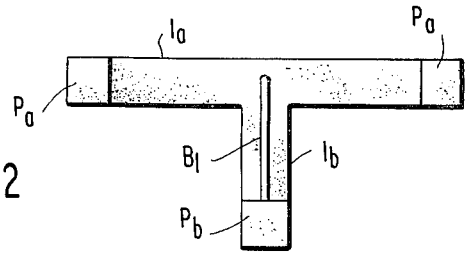
FIG. 2
FIG. 3
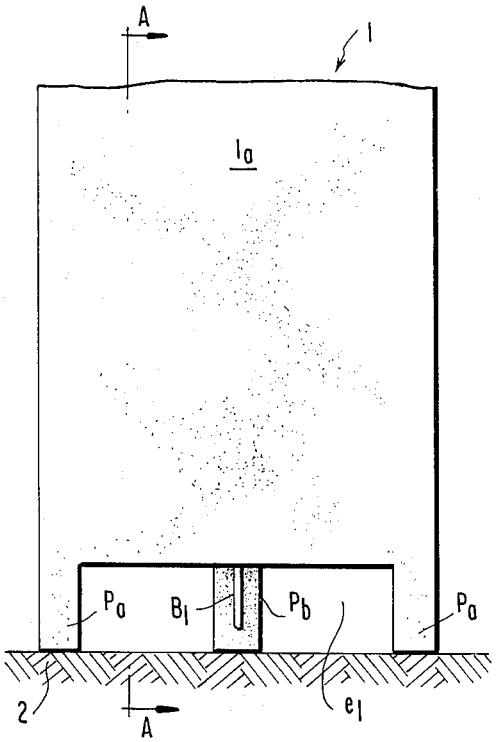
FIG. 4
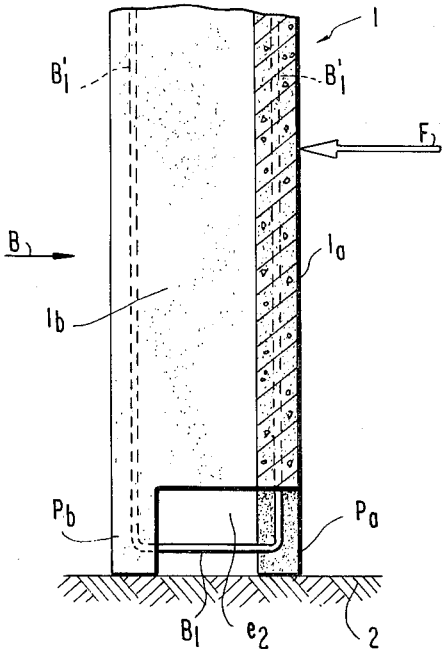

VERTICAL MODULAR CONSTRUCTION ELEMENT AND CONSTRUCTION METHOD USING THE SAME

The present invention relates to concrete constructions, and more particularly those of the type that are constructed for retention purposes.

It is known, in the construction of walls and retaining walls for liquids and/or earth, to construct the same according to two principal techniques:

According to the first technique, the construction is effected in place. A concrete foundation is cast, with reinforcing rods extending therefrom for subsequent connection to the building, after which the structure is added which will resist the forces that arise under the circumstances.

According to the second method, prefabricated units are used at least in part. These units are often of L-shaped or inverted T-shape or even of more complicated cast shapes with a surface that bears on the soil incorporated in their structure. Often these prefabricated units have reinforcing rods cast therein and extending therefrom, so that further constructions can be connected to them by casting.

These known methods and constructions have a number of drawbacks. In the case of totally prefabricated constructions, the weight is quite high, and, because of their size, which is often 10 to 15 feet in height, their transportation is difficult and so they tend to become economically undesirable. Moreover, modifications during construction are virtually impossible.

Also, unforeseen developments during construction, make the use of prefabricated units as heretofore known, impractical.

The present invention has as its object to overcome these difficulties of the known techniques and constructions, by providing a vertical modular construction unit of novel construction and a new method for the use of the same.

According to the present invention, the base of the vertical modular construction unit is provided with feet between which is disposed at least one closed steel loop in a vertical plane, for the reception of reinforcing rods of the foundation to be cast about the feet of a plurality of these modular elements disposed in side-by-side relationship.

The invention also comprises the method by which such elements are assembled, interconnected and integrated by casting.

More particularly, the present invention:

relates to a construction which permits the use of modular reinforced concrete upright elements that can be interconnected at the level of the foundation regardless of the nature of the soil at this location;

permits the emplacement of the reinforcing rods and the casting of the foundation entirely after emplacement of the series of vertical modular elements, whereby the arrangement and position of the modular elements can be changed up until the very time in which the reinforcing rods are strung and the foundation cast;

permits, thanks to these features, before the casting of the foundation and after the emplacement of the series of prefabricated units, the construction of the formwork within which casting will be performed, and thereby avoids difficulties that arise from unforeseeable construction circumstances.

The present invention permits construction of vertical walls from prefabricated elements having either one of two forms:

A—the wall can be composed of modular elements of rectangular or even trapezoidal cross section.

According to the invention, in the course of prefabrication, there is provided at the lower end of these modular elements, a plurality of supporting feet whose height is greater than the closed steel loops which depend below the elements, in the space between the feet, a distance less than the height of the feet.

According to the invention, these loops are comprised by steel rods of U-shape whose vertical legs are embedded in the concrete of the upper part of each modular element so as to ensure firm anchorage and the transmission of vertical tension, only the lower portion of these U-shaped rods being exposed to form the above-described closed loops. The weight of the modular elements is thus transmitted to the soil by the spaced feet, which, like the elements themselves, are of concrete and may be reinforced or not. The closed loops, however, depend from the modular elements a distance less than the height of the feet, so that they are not crushed by the weight of the modular elements against the soil.

To this end, the size and shape of the feet are chosen to satisfy the following conditions:

they support the weight of the superposed element;

they ensure by their position and number the stability of the element when supported by the feet on the ground;

and they permit by their position the threading of the reinforcing steel rods of the foundation footings.

The principal reinforcing rods of the foundation footings are of such number and size that they pass between the supporting feet and through the closed steel loops, their horizontal position having a certain degree of freedom up to the casting of the concrete of the foundation.

Thus, when the modular elements are in proper position, the reinforcing rods can slide freely therebeneath while passing between the feet and through the closed loops, with the result that the position of the horizontal reinforcing rods of the foundation footings can easily be changed as desired relative to the modular elements that are already in place and resting on the ground.

B—the vertical modular construction elements of the present invention can be of T-shape, or, more broadly, be comprised by one principal rib and one or more secondary ribs joined thereto at right angles.

According to this latter construction of the modular element, the supporting feet are disposed at the free edges of the ribs, and more particularly at both free edges of the main rib and the free edge of each secondary rib. Assuming the secondary ribs to be toward what might be called the rear of the resulting construction, the feet on the principal rib thus become the forward feet and the feet on the secondary ribs the rear feet. The closed steel loops are embedded in these rear feet, whence they extend upward in embedded fashion along the length of the free edge of the secondary rib.

Also according to the present invention, the front and rear feet are spaced forwardly and rearwardly from each other, respectively, as seen from the side, such that a substantial length of loop is exposed for the threading therethrough of horizontal steel reinforcing rods before casting the foundation.

Other features and advantages of the present invention will become apparent from a consideration of the following description, taken in connection with the accompanying drawings, in which:

FIG. 1 is a fragmentary perspective view of the lower end of a vertical modular construction element according to the invention, shown in lowered position;

FIGS. 2 and 3 are respectively bottom plan and elevational views of the element of FIG. 1, upright and resting on the substrate soil in the latter case;

FIG. 4 is a cross-sectional view on the line A—A of FIG. 3;

As will be seen from FIGS. 1–4, the modular vertical construction element 1 of cast concrete is generally T-shaped in cross section and can be considered to comprise two flat ribs $l_a$ and $l_b$, at right angles to each other, and having at its lower end, which is the end shown in FIGS. 1–4 and which is destined to rest on the soil:

- a recess $e_1$ disposed between two feet $P_a$, which can be called forward feet
- a recess $e_2$, disposed at the end of rib $l_b$ and bordered by a foot $P_b$ which can be considered to be a rear foot
- a steel loop $B_1$, which is closed and is disposed in recess $e_2$ and has one portion embedded in foot $P_b$ and another portion embedded in the juncture of ribs $l_a$ and $l_b$.

It will be noted, with particular reference to FIG. 4, that on the one hand the loop $B_1$ is not in contact with the foundation soil 2, and on the other hand that the vertical prolongations $B'_a$ of the loop are embedded in the mass of element 1 along its entire height, so as to resist pressures exerted in the direction of the arrow F when the construction comprising a number of elements 1 disposed side-by-side is completed.

Figure 5:
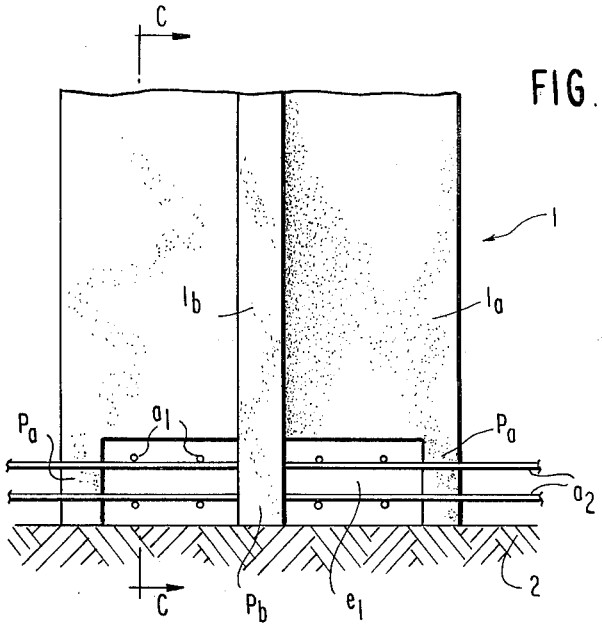
FIG. 5 is a view taken in the direction of the arrow B of FIG. 4, showing the reinforcing rod footings which secure the base of the modular element.
Figure 6:
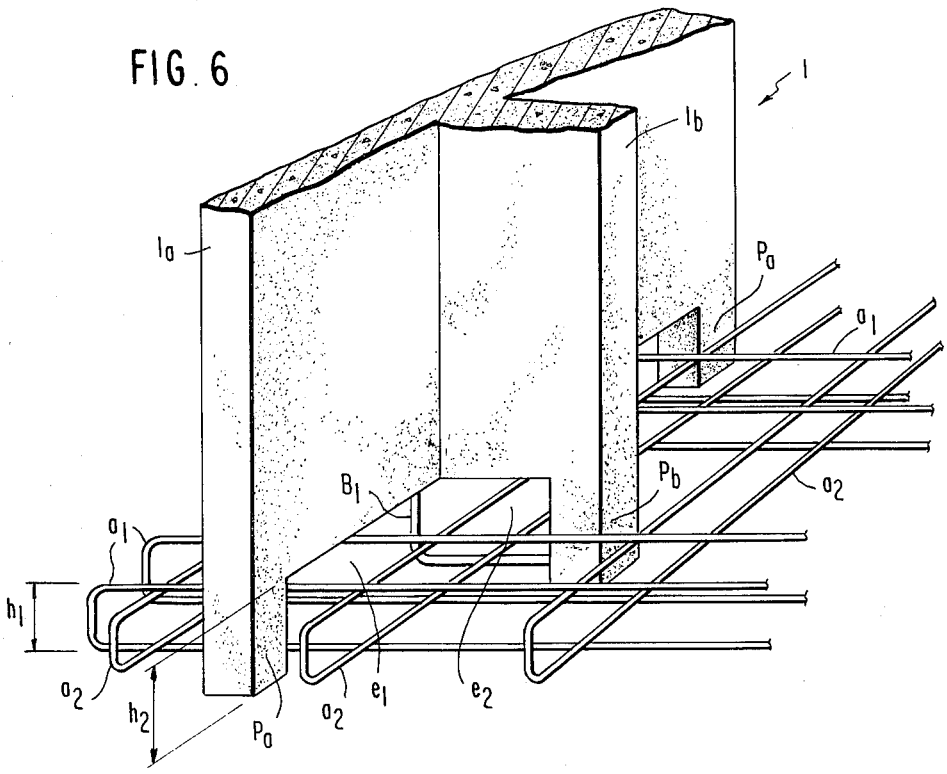
FIG. 6 is a three-quarter perspective view from above, showing the structure of FIG. 5.

Element 1 thus rests on the foundation soil 2 with its three feet $P_a$ and $P_b$, between which (see FIGS. 5 and 6) are slid, perpendicular to the plane of rib $l_a$, the principal steel reinforcing rods $a_1$ of the foundation footings to be constructed, disposed either in the form of a U, or in the form of two independent layers, such that their height $h_1$ will be less than the height $h_2$ of feet $P_a$ and $P_b$ of element 1. This arrangement permits easy arrangement of the reinforcing rods of the footings within recess $e_1$, before pouring the footings.

Figure 7:
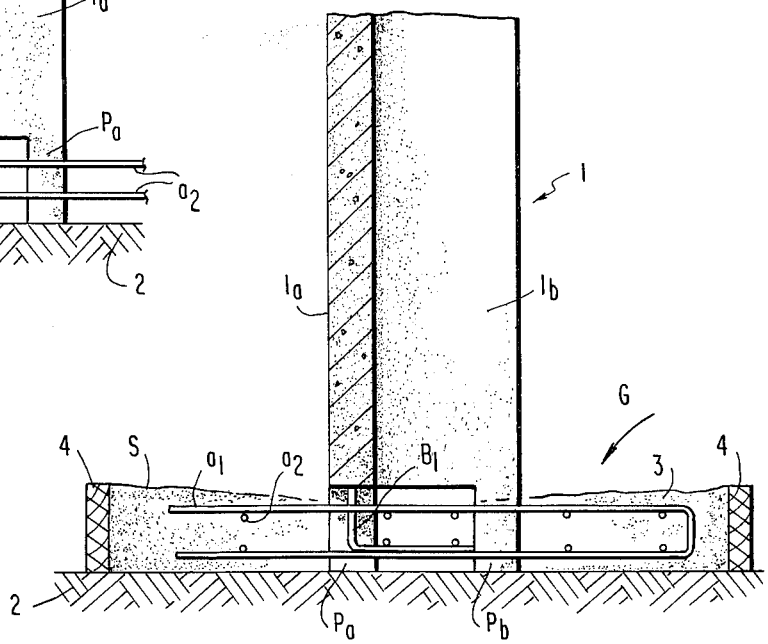
FIG. 7 is a cross-sectional view on the line C—C of FIG. 5, during pouring of the foundation footings.

The spacing rods or stringers $a_2$ are then installed by sliding them through loops $B_1$ to reinforce and interconnect the rods $a_1$, after which the concrete 3 of the foundation footings S is cast, as shown by the arrow G in FIG. 7. This concrete 3, which is held in place by forms 4 until it sets, permits the rods $a_1$ to assume the load transmitted by the vertical portions $b'_1$ of the loop $B_1$. The height of the footings S thus constructed is a little greater than the height $h_2$ of the feet $P_a$ and $P_b$.

Figure 8:
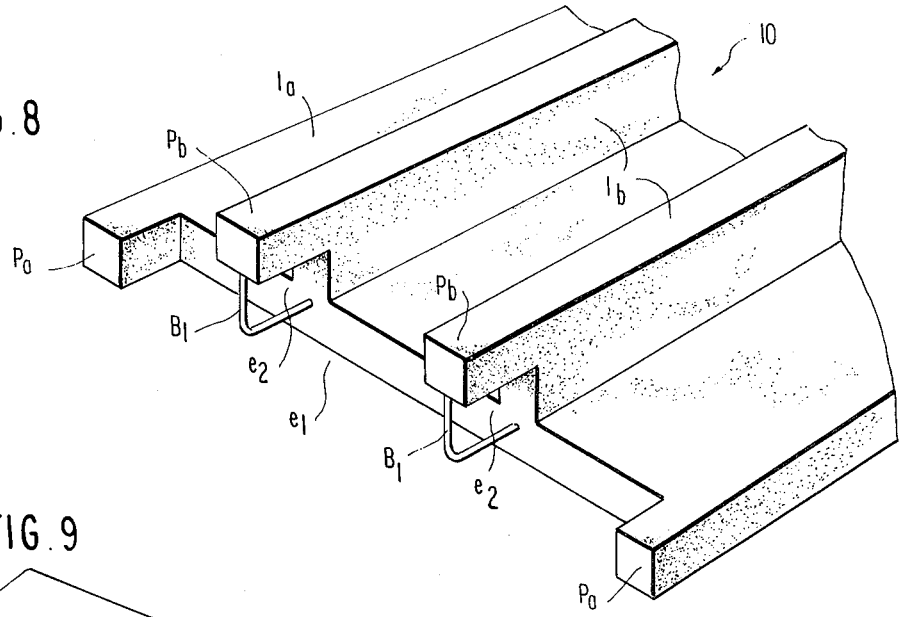
FIGS. 8, 9 and 10 are fragmentary perspective views showing three alternative embodiments of the vertical modular construction element according to the invention.

FIG. 8 shows a modified form of the element 1 described above. Thus, the modular element 10 shown in FIG. 8 comprises two ribs $l_b$ and, as a result, two recesses $e_2$, two rear feet $P_b$ and two loops $B_1$.

Figure 9:
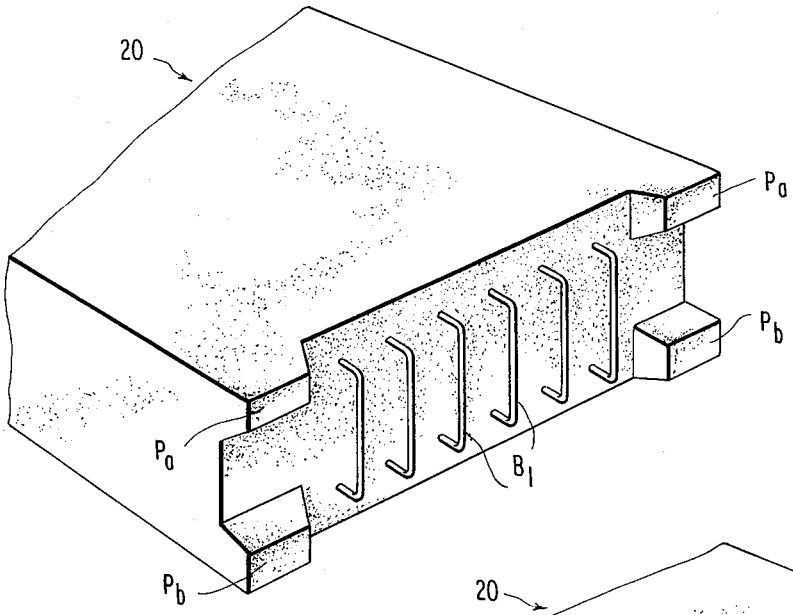
Figure 10:
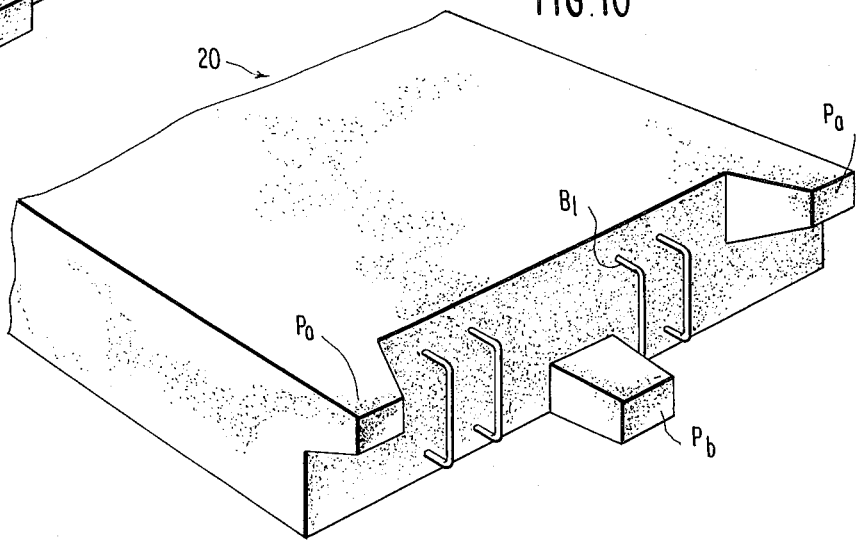

FIGS. 9 and 10 show a modular element 20 according to the invention, having a rectangular cross-sectional configuration. The base of this element comprises supporting feet which are either four in number (two forward feet $P_a$ and two rear feet $P_b$, see FIG. 9), or three in number (two forward feet $P_a$ and one rear foot, $P_b$, see FIG. 10), and a plurality of loops $B_1$ juxtaposed in such a manner as to cooperate with the reinforcing rods of foundation footings S.

The vertical modular elements of the present invention have numerous applications, particularly in the following constructions:

- foundation walls
- retention walls for agricultural products (silos, bins, etc.)
- reservoirs for drinking water
- sea walls
- bank vault walls
- basements
- holding basins
- pools
- bridge piers.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention, as defined by the appended claims.

What is claimed is:

1. A method for constructing a masonary retaining wall, comprising disposing a plurality of modular masonary construction elements side by side on end, each said element being of T-shaped cross section in which the crosspiece of the T comprises a principal rib and the stem of the T comprises at least one secondary rib joined thereto at right angles, said element having at least three supporting feet each in prolongation of a free edge of a said rib, said feet being spaced apart by recesses, and at least one U-shaped steel rod embedded in said element in the plane of a said secondary rib and having two vertical legs one of which is embedded in the free edge of said seconary rib and extends down into said foot of said secondary rib but is spaced above the lower end of said foot, the other said leg being embedded in the junction between said at least one secondary rib and said primary rib, a portion of the bottom of said loop being exposed within said recesses, said principal ribs of said modular elements being disposed in edge-to-edge relationship with each other, threading horizontal steel reinforcing rods through said exposed portions of said U-shaped rods and through said recesses from element to element with each horizontal reinforcing rod extending between a plurality of said elements, threading further steel horizontal reinforcing rods parallel to the first-mentioned steel horizontal reinforcing rods and disposed on opposite sides of the plane of said principal ribs, threading horizontal steel reinforcing rods through said recesses parallel to the plane of said U-shaped rod and on opposite sides thereof and above the first-mentioned said rods, and casting concrete about the lower ends of said elements to embed said exposed portions and feet and reinforcing rods in said concrete.

2. A masonry retaining wall, comprising a plurality of modular masonry construction elements disposed side by side on end, each said element being of T-shaped cross section in which the crosspiece of the T comprises a principal rib and the stem of the T comprises at least one secondary rib joined thereto at right angles, said element having at least three supporting feet each in prolongation of a free edge of a said rib, said feet being spaced apart by recesses, and at least one U-shaped steel rod embedded in said element in the plane of a said secondary rib and having two vertical legs one of which is embedded in the free edge of said secondary rib and extends down into said foot of said secondary rib but is spaced above the lower end of said foot, the other said leg being embedded in the junction between said at least one secondary rib and said primary rib, a portion of the bottom of said loop being exposed within said recesses, said principal ribs of said modular elements being disposed in edge-to-edge relationship with each other, horizontal steel reinforcing rods extending through said exposed portions of said U-shaped rods and through said recesses from element to element with each horizontal reinforcing rod extending between a plurality of said elements, further steel horizontal reinforcing rods extending parallel to the first-mentioned steel horizontal reinforcing rods and disposed on opposite sides of the plane of said principal ribs, horizontal steel reinforcing rods extending through said recesses parallel to the plane of said U-shaped rod and on opposite sides thereof and above the first-mentioned said rods, and a concrete casting about the lower ends of said elements, said exposed portions and feet and reinforcing rods being embedded in said concrete.

* * * * *